US007578415B2

(12) United States Patent
Ziesel et al.

(10) Patent No.: US 7,578,415 B2
(45) Date of Patent: Aug. 25, 2009

(54) DISPENSING NOZZLE ASSEMBLY

(75) Inventors: Lawrence B. Ziesel, Woodstock, GA (US); David Harvey, Suwanee, GA (US)

(73) Assignee: The Coca-Cola Company, Atlanta, GA (US)

( * ) Notice: Subject to any disclaimer, the term of this patent is extended or adjusted under 35 U.S.C. 154(b) by 488 days.

(21) Appl. No.: 11/276,551

(22) Filed: Mar. 6, 2006

(65) Prior Publication Data

US 2007/0205219 A1 Sep. 6, 2007

(51) Int. Cl.
*B67D 5/56* (2006.01)

(52) U.S. Cl. ..... 222/129.1

(58) Field of Classification Search ..... 222/129, 222/129.1, 129.2, 129.3, 129.4, 129.5; 239/581.1, 239/428, 391, 393, 428.5
See application file for complete search history.

(56) References Cited

U.S. PATENT DOCUMENTS

| | | | | |
|---|---|---|---|---|
| 4,211,342 | A | 7/1980 | Jamgochian et al. | |
| 4,218,014 | A * | 8/1980 | Tracy | 239/106 |
| 4,392,588 | A | 7/1983 | Scalera | |
| 4,619,378 | A | 10/1986 | de Man | |
| 4,753,370 | A | 6/1988 | Rudick | |
| 4,821,925 | A | 4/1989 | Wiley et al. | |
| 5,000,357 | A | 3/1991 | Shannon et al. | |
| 5,033,651 | A | 7/1991 | Whigham et al. | |
| 5,048,726 | A * | 9/1991 | McCann et al. | 222/129.1 |
| 5,203,474 | A * | 4/1993 | Haynes | 222/129.1 |
| 5,685,639 | A * | 11/1997 | Green | 366/101 |
| 5,803,320 | A | 9/1998 | Cutting et al. | |
| 6,047,859 | A | 4/2000 | Schroeder et al. | |
| 6,253,963 | B1 * | 7/2001 | Tachibana | 222/129.1 |
| 6,321,938 | B1 | 11/2001 | Edwards et al. | |
| 6,345,729 | B1 | 2/2002 | Santy, Jr. | |
| 6,364,159 | B1 | 4/2002 | Newman et al. | |
| 6,871,761 | B2 * | 3/2005 | Fox | 222/129.1 |
| 6,877,635 | B2 * | 4/2005 | Stratton | 222/1 |
| 7,077,290 | B2 | 7/2006 | Bethuy et al. | |
| 7,108,024 | B2 | 9/2006 | Navarro | |
| 7,108,156 | B2 | 9/2006 | Fox | |
| 7,147,131 | B2 | 12/2006 | Sher et al. | |
| 7,156,259 | B2 | 1/2007 | Bethuy et al. | |
| 7,159,743 | B2 | 1/2007 | Brandt et al. | |
| 7,290,680 | B2 * | 11/2007 | Henry et al. | 222/129.1 |
| 7,322,535 | B2 * | 1/2008 | Erdely | 239/581.1 |
| 2004/0040983 | A1 | 3/2004 | Ziesel | |
| 2005/0269360 | A1 | 12/2005 | Piatnik et al. | |
| 2006/0097009 | A1 | 5/2006 | Bethuy et al. | |

(Continued)

FOREIGN PATENT DOCUMENTS

| | | | |
|---|---|---|---|
| AT | 381482 | B | 8/1984 |

(Continued)

*Primary Examiner*—Kevin P Shaver
*Assistant Examiner*—Michael Hagedorn
(74) *Attorney, Agent, or Firm*—Sutherland Asbill & Brennan LLP

(57) ABSTRACT

The present application describes a nozzle assembly. The nozzle assembly may include a flow director with a first flow path and a second flow path, a tertiary flow assembly with a number of third flow paths, and an elongated target positioned about the flow director such that the first flow path, the second flow path, and the number of third flow paths merge along the elongated target.

33 Claims, 12 Drawing Sheets

U.S. PATENT DOCUMENTS

| | | | |
|---|---|---|---|
| 2006/0174778 | A1 | 8/2006 | Greiwe |
| 2006/0196886 | A1 | 9/2006 | Fox |
| 2006/0213928 | A1 | 9/2006 | Ufheil et al. |
| 2007/0009365 | A1 | 1/2007 | Litterst et al. |
| 2007/0080169 | A1 | 4/2007 | Sher et al. |
| 2007/0131715 | A1 | 6/2007 | Minard et al. |
| 2008/0093382 | A1 | 4/2008 | Sher et al. |

FOREIGN PATENT DOCUMENTS

| | | | |
|---|---|---|---|
| EP | 0158096 | A2 | 3/1985 |
| EP | 0672616 | A2 | 3/1995 |
| WO | 9850165 | A1 | 11/1998 |
| WO | 00/07928 | | 2/2000 |
| WO | 2006/024409 | A2 | 3/2006 |
| WO | 2006/070257 | | 10/2006 |
| WO | 2007/002575 | | 1/2007 |

* cited by examiner

DISPENSING NOZZLE ASSEMBLY

TECHNICAL FIELD

The present application relates generally to nozzles for beverage dispensers and, more particularly, relates to multi-flavor or multi-fluid dispensing nozzles.

BACKGROUND OF THE INVENTION

Current post-mix beverage dispenser nozzles generally mix a stream of syrup, concentrate, sweetener, bonus flavor, or other type of flavoring ingredient with water or other types of diluent by flowing the syrup stream down the center of the nozzle with the water stream flowing around the outside. The syrup stream is directed downward with the water stream as the streams mix and fall into a cup.

There is a desire for a beverage dispensing system as a whole to provide as many different types and flavors of beverages as may be possible in a footprint that is as small as possible. Preferably, a beverage dispenser can provide as many beverages as may be available on the market in pre-packaged bottles or cans.

In order to accommodate this variety, the dispensing nozzles themselves need to accommodate fluids with different viscosities, flow rates, mixing ratios, temperatures and other variables. Current nozzles may not be able to accommodate multiple beverages with a single nozzle design and/or the nozzle may be designed for specific types of fluid flow. One known means of accommodating differing flow characteristics is shown in commonly owned U.S. patent application Ser. No. 10/233,867 (U.S. Patent Application Publication Number U.S. 2004/0040983A1) that shows the use of modular fluid modules that are sized and shaped for specific flow characteristics. U.S. patent application Ser. No. 10/233,867 is incorporated herein by reference.

There is a desire, however, for a dispensing nozzle to accommodate even more and different types of fluids that may pass therethrough. The nozzle preferably should be able to accommodate this variety while still providing good mixing.

SUMMARY OF THE INVENTION

The present application thus describes a nozzle assembly. The nozzle assembly may include a flow director with a first flow path and a second flow path, a tertiary flow assembly with a number of third flow paths, and an elongated target positioned about the flow director such that the first flow path, the second flow path, and the number of third flow paths merge along the elongated target.

The flow director may include an outer chamber. The outer chamber may include an internal shelf with a number of shelf apertures therein. The first flow path extends through the shelf apertures. The outer chamber may include a number of floor apertures. The flow director may include an inner cylinder positioned within the outer chamber. The inner chamber may include a number of conduits in communication with the floor apertures. The second flow path extends through the conduits and the floor apertures. The target may include a number of fins that define a number of channels. The first flow path and the second flow path extend along the channels. The nozzle assembly further may include a ring positioned about the flow director adjacent to the first flow path and the second flow path.

The tertiary flow assembly encircles the flow director in full or in part. The tertiary flow assembly may include a number of conduits extending therethrough for the third flow paths. The conduits may include a number of different sizes and different configurations.

The inner cylinder may include a first conduit and a second conduit therethrough. The first flow path extends through the first conduit and the shelf apertures. The second flow path extends through the second conduit and the floor apertures.

The tertiary assembly may include a number of flow modules. The flow modules may include a number of conduits extending therethrough for the number of third flow paths. The conduits may include a number of different sizes and different configurations. The flow modules may include a multi-aperture module. The multi-aperture module may include a number of multi-aperture modules with apertures of a number of difference sizes and difference configurations.

The present application further describes a nozzle assembly. The nozzle assembly may include an outer chamber, an inner chamber, a tertiary flow assembly and a target. The outer chamber may include a first number of apertures and a second number of apertures. The inner cylinder may be positioned within the outer chamber. The inner cylinder may include a first conduit and a second conduit. The first conduit is in communication with the first number of apertures and the second conduit is in communication with the second number of apertures. The tertiary flow assembly may include a number of flow modules. The target may be positioned about the first apertures, the second apertures, and the flow modules.

The flow modules may include a number of conduits extending therethrough for the number of third flow paths. The conduits may include a number of different sizes and different configurations. The flow modules may include a multi-aperture module.

The present application further describes a nozzle assembly. The nozzle assembly may include a flow director with one or more flow paths therein and a flow assembly with a number of modules. The modules may include a number of micro-ingredient flow paths sized for fluids having a reconstitution ratio of about ten to one (10:1) or higher. The flow director may include a macro-ingredient flow path therein. A target may be positioned beneath the flow director. The modules may include a multi-aperture module.

The present application further describes a method of dispensing a beverage through a nozzle assembly having a target. The method may include flowing a first fluid stream along the target flowing a micro-ingredient fluid stream along the target, mixing in part the first fluid stream and the micro-ingredient fluid stream along the target, and stopping the flow of the micro-ingredient fluid stream before stopping the flow of the first fluid stream along the target so as to flush any remaining micro-ingredient fluid off of the target. The step of flowing a micro-ingredient fluid stream may include flowing a colored micro-ingredient fluid stream.

These and other features of the present application will become apparent to one of ordinary skill in the art upon review of the following detailed disclosure when taken in conjunction with the drawings and the appended claims.

DETAILED DESCRIPTION

Figure 1:
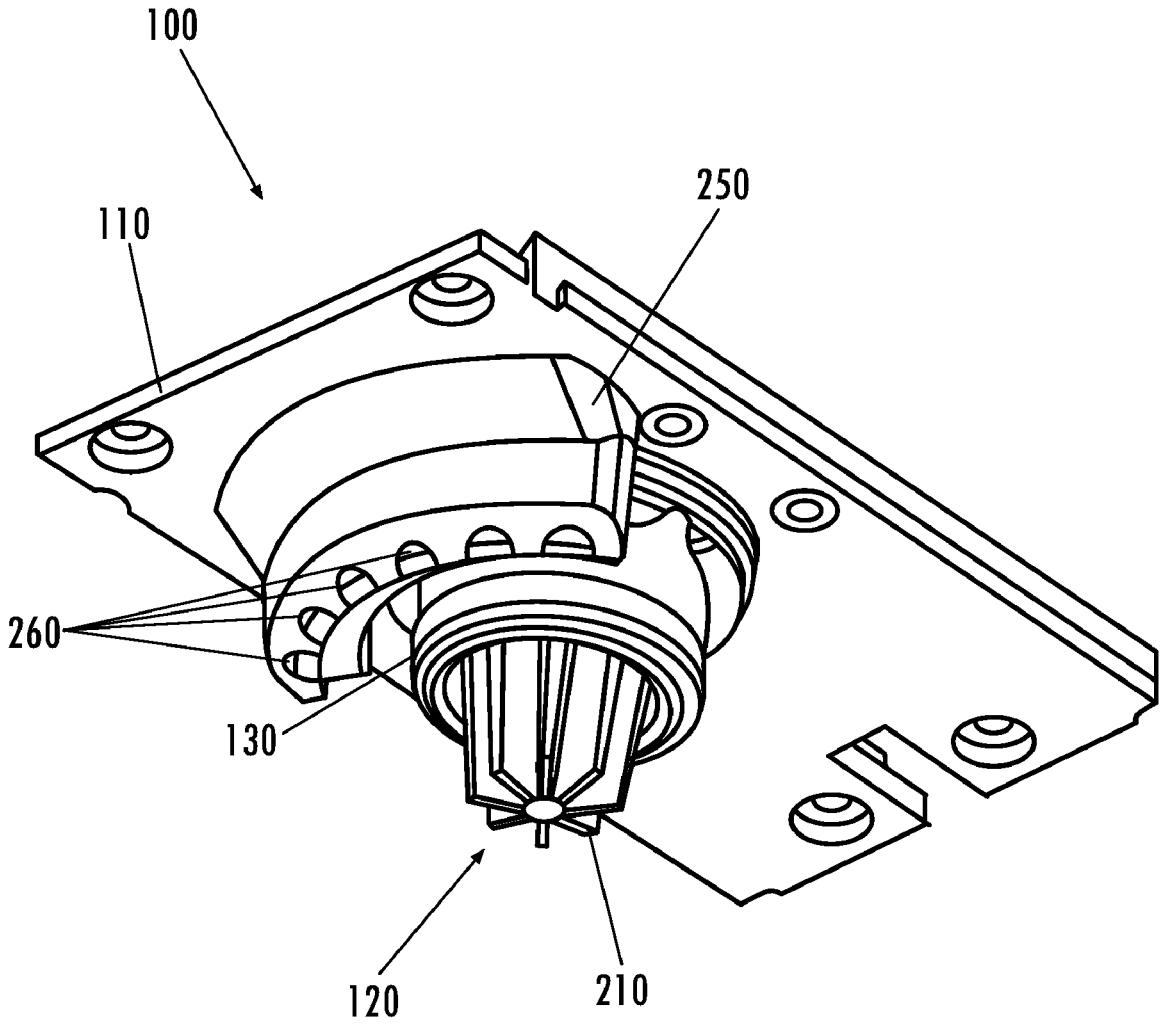
FIG. 1 is a perspective view of a dispensing nozzle assembly as is described herein.
Figure 2:
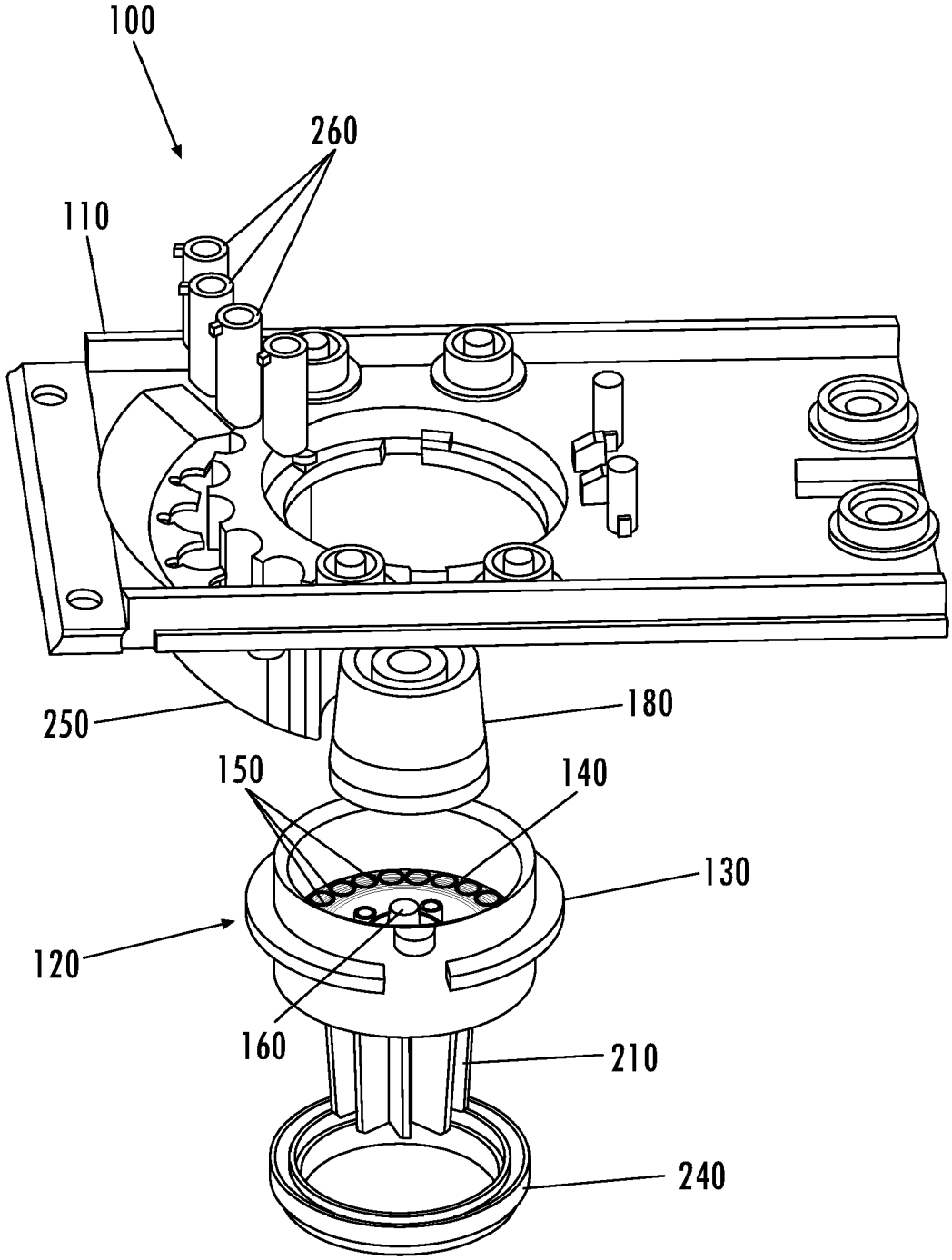
FIG. 2 is an exploded view of the dispensing nozzle assembly of FIG. 1.
Figure 3:
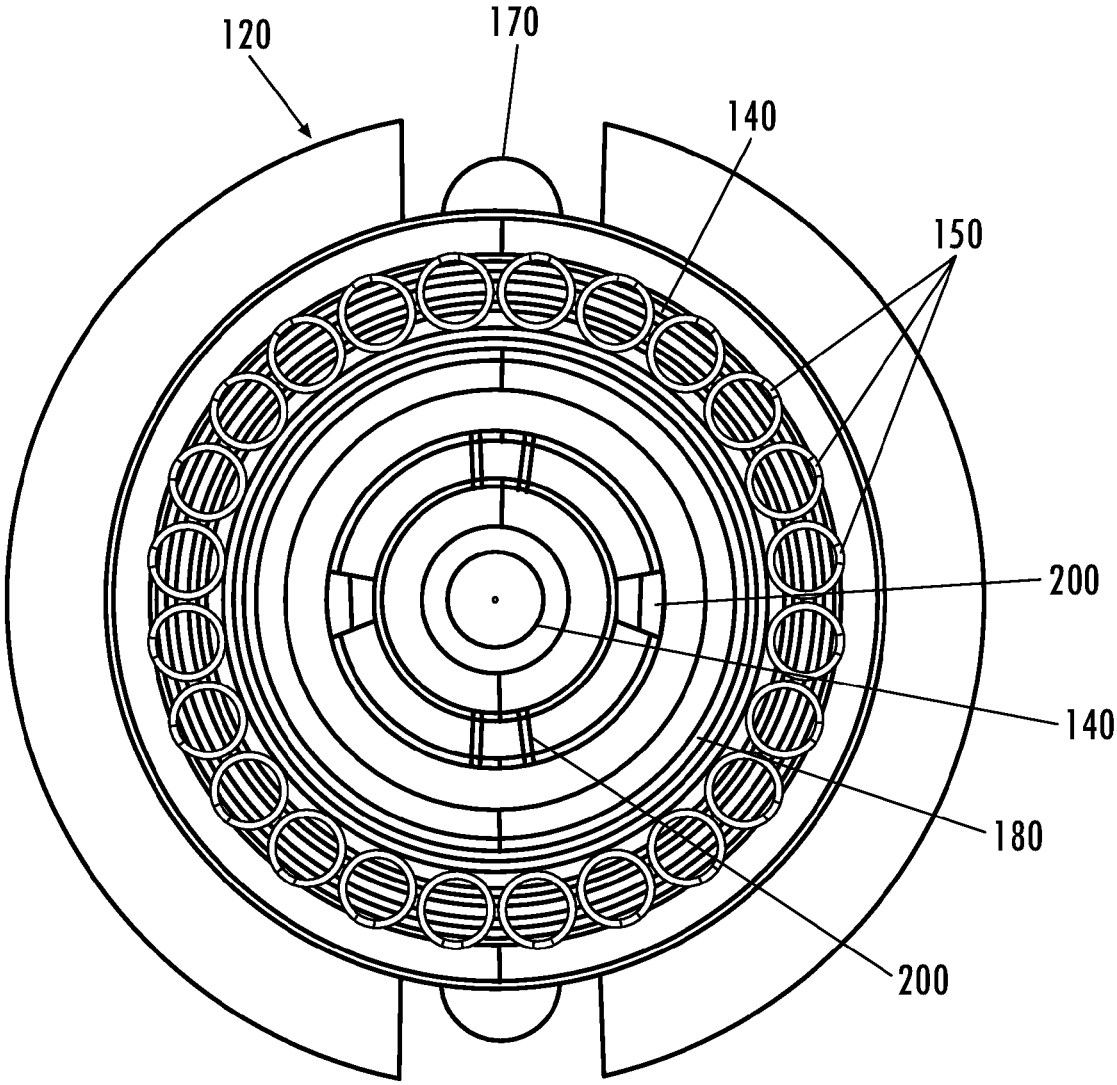
FIG. 3 is a top plan view of the dispensing nozzle assembly of FIG. 1.
Figure 4:
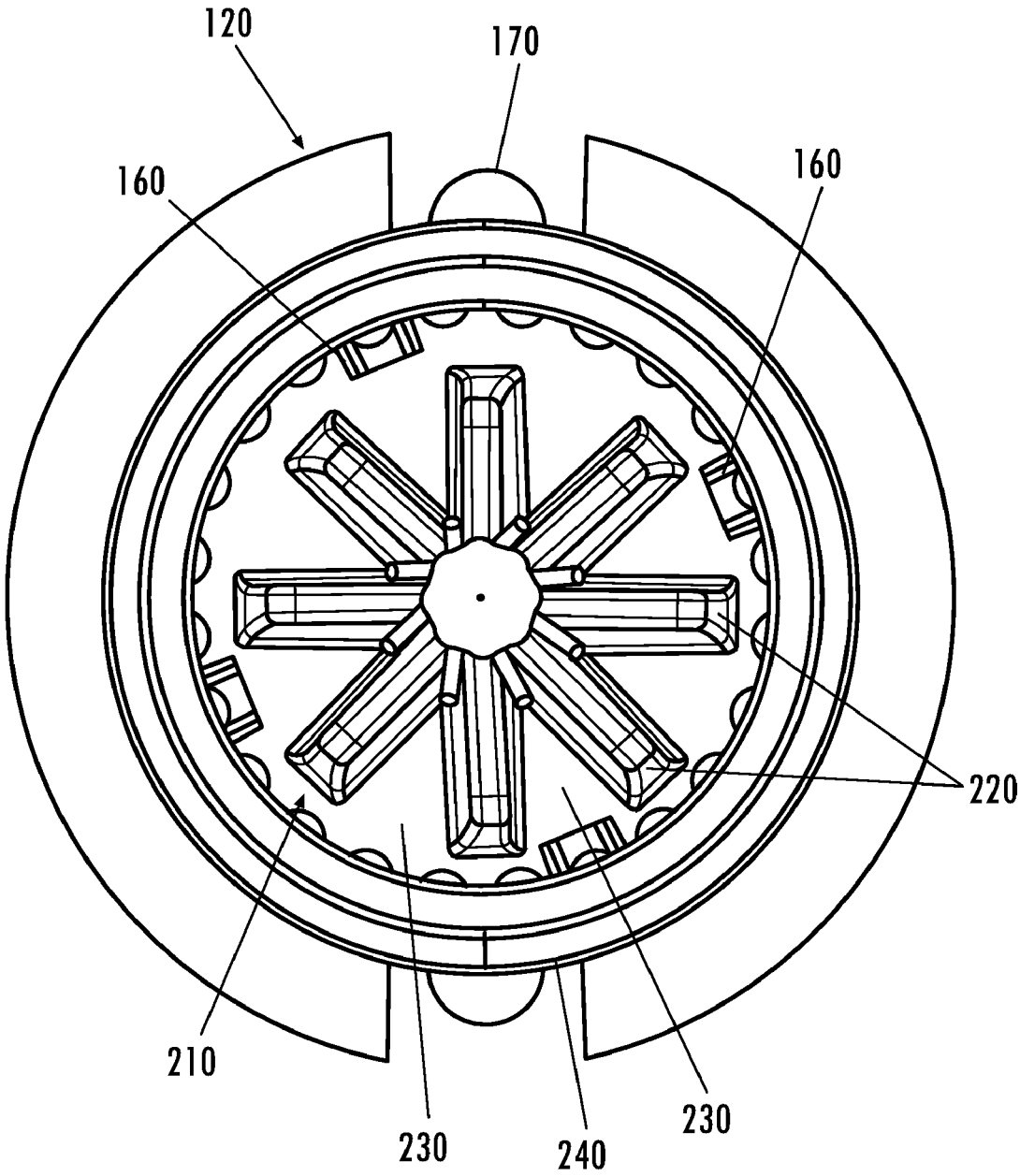
FIG. 4 is a bottom plan view of the dispensing nozzle assembly of FIG. 1.

Referring now to the drawings, in which like numerals refer to like elements throughout the several views, FIGS. 1 through 4 show a dispensing nozzle assembly 100 as is described herein. The dispensing nozzle assembly 100 may include a base 110 that is suitable for mounting the various components of the dispensing nozzle assembly 100 as a whole.

Position within the base 110 may be a flow director 120. The flow director 120 may be a single or a multi piece part. Specifically, the flow director 120 may include an outer chamber 130. The outer chamber 130 is largely circular in shape. (Although the term "circular" is used herein, other types of smoothed or irregular shapes may be used herein.) The outer chamber 130 may include a raised shelf 140 that encircles an inside wall of the chamber 130. The shelf 140 may include a number of shelf apertures 150 therein. The shelf apertures 150 extend through the shelf 140 and out through the bottom of the outer chamber 130. Any number of shelf apertures 150 may be used herein. The outer chamber 130 further may include a number of floor apertures 160 positioned at the bottom of the outer chamber 130. The floor apertures 160 also may extend out through the bottom of the outer chamber 130. The floor apertures 160 may be somewhat larger than the shelf apertures 150. Fewer floor apertures 160 may be used as compared to the shelf apertures 150.

The outer chamber 130 also may include a connector 170 so as to attach the outer chamber 130 to the base 110. The connector 130 may be a raised boss for the insertion of a screw or bolt therethrough or the outer chamber 130 may twist on to the base 110. Any type of connection means may be used herein, including snap on or clamp on.

The flow director 120 also may have an inner cylinder 180 positioned within the outer chamber 130. The inner cylinder 180 may have a central aperture 190 that extends therethrough. The central aperture 190 may lead to a number of conduits 200. The inner cylinder 180 may be positioned within the outer chamber 130 such that the conduits 200 align with the floor apertures 160 thereof. The inner cylinder 180 seals off the floor apertures 160 as they are positioned below the shelf apertures 150. (Although the term "cylinder" is used herein, other types of smoothed or irregular shapes may be used herein.)

The dispensing nozzle assembly 100 further may include a target 210. The target 210 may be positioned below the outer chamber 130 of the flow director 120. In this example, the target 210 and the outer chamber 130 may be a single element. Multiple element parts also may be used. The target 210 may include a number of vertically extending fins 220 that extend into a largely star shaped appearance as seen from the bottom view of FIG. 4. The fins 220 form a number of U or V shape channels 230. The channels 230 may largely align with the shelf apertures 150 and the floor apertures 160.

The dispensing nozzle assembly 100 further may include a lower ring 240. The ring 240 may surround the bottom of the outer chamber 130 and may be positioned partially underneath the shelf apertures 150 and the floor apertures 160 so as to deflect a flow stream therethrough towards the target 210.

Position adjacent to the flow director 120 may be a tertiary flow assembly 250. The tertiary flow assembly 250 may be attached to the base 110 and may include a number of conduits 260 positioned therein. Although the tertiary flow assembly 250 is shown as being on one side of the flow director 120, the tertiary flow assembly 250 may completely encircle the flow director 120 or any portion thereof. Any number of conduits 260 may be used therein. The conduits 260 may be angled such that a flow stream therethrough is aimed at the target 210 below the flow director 120. The conduits 260 may be sized and/or configured to accommodate a particular type of fluid flow characteristics. Likewise, the conduits 260 may be sized to accommodate a particular type or speed of pump or metering device. The tertiary flow assembly 250 may have conduits 260 of differing size or configuration based upon the different types of fluids intended to be used therein.

The components herein may be made out of plastics, metals, or any suitable material. Coated materials such as Teflon and glass also may be used. The materials may have non-wetting properties and may be resistant to corrosion, stains, contamination, bacteria, fungus, etc. The fluid contacting components may have micro or nano surface structure to aid in fluid flow, mixing, and cleaning operations.

In use, the flow director 120 may be used without tertiary flow assembly 250. The flow director 120, in general, may be used for diluents or macro-ingredients. Generally described, the macro-ingredients have reconstitution ratios in the range of about three to one (3:1) to about six to one (6:1). In this example, syrup, concentrate, sweetener, or other type of fluid may flow through the central aperture 190 of the inner cylinder 180. The syrup or other type of fluid may then flow through the conduits 200 and out via the floor apertures 160 towards the target 210. Likewise, water, other types of diluents, or other types of fluid may flow into the outer chamber 130 and down through the shelf apertures 150 towards the target 210. The same type of fluid also may be used for the inner cylinder 180 and the outer chamber 130. The fluids merge and mix within the flow director 120 and continue mixing as they flow down along the channels 230 of the target 210 and into a cup.

Alternatively, the flow director 120 also may be used with the tertiary flow assembly 250. The tertiary flow assembly 250, in general, may be used for micro-ingredients. Generally described, the micro-ingredients may have a reconstitution ratio ranging of about ten to one (10:1), twenty to one (20:1), thirty to one (30:1), or higher. Specifically, many micro-ingredients may be in the range of fifty to one (50:1) to three hundred to one (300:1). The flow director 110 may operate as described above with the secondary assembly providing a tertiary fluid, e.g., a bonus flavor such as a vanilla or a cherry flavor additive or any type of natural or artificial flavoring ingredients. Furthermore, other types of additives, such as natural or artificial colors; sweeteners; functional additives, such as vitamins, minerals, herbal extracts and over-the-counter medicines; and any other type of fluid or other ingredients may be used herein. As is described in commonly owned U.S. patent application Ser. No. 11/276,553, the acid and non-acid components of a concentrate also may be delivered separately. U.S. patent application Ser. No. 11/276,553, entitled "Methods and Apparatuses for Making Compositions Comprising an Acid and an Acid Degradable Component and/or Compositions Comprising a Plurality of Selectable Components" is incorporated herein by reference. Various types of alcohol also may be used. (By "tertiary" we mean any type of fluid added to the fluid streams passing through the flow director 120. As described below, any number of fluid streams may flow through the flow director 120 such that "tertiary" is not limited to a third stream.)

The tertiary fluid thus flows through the conduits 200 and is aimed towards the target 210. The tertiary fluid mixes with the other fluid streams as they travel down the channels 230 of the target 210. More than one tertiary fluid may be added at the same time. Alternatively, the tertiary fluid may be aimed below the target 210 and may air mix with the other fluids as they pass the target.

In a still further example, a sweetener such as high fructose corn syrup ("HFCS") or other type of macro-ingredient may travel through the inner cylinder 180 of the flow director 120 instead of the syrup, concentrate, or other fluid. Water or other fluids may flow through the outer chamber 130 as described above. Instead of or in addition to the tertiary fluids described above, an unsweetened flavor concentrate or other type of micro-ingredient may flow through the conduits 260 of the tertiary assembly 250. The unsweetened flavor concentrate, the HFCS, and the water or other fluids thus may mix as the fluids flow down the channels 230 of the target 210. Likewise, the tertiary fluid may air mix with the other fluids below the target 210. In this arrangement, the dispensing nozzle assembly 100 as a whole thus can accommodate many different types of flavor concentrates and other fluids. The sweetener or other type of macro-ingredients may be stored in a conventional bag in box or a similar type of container external to the dispenser while the unsweetened flavor concentrate or other type of micro-ingredients may be stored in or about the dispenser.

Similarly, a macro-ingredient base product may be stored in a bag in box or a similar type of container external to the dispenser. The base product may include the sweetener, acid, and other common components. A number of tertiary micro-ingredients may be positioned within or about the dispenser. In this case, the micro-ingredients are flavor additives that create the beverage. As such, a single base product may be used with several flavor additives to create several related beverages.

The tertiary flow assembly 250 also may be added separately to an existing nozzle assembly in a retrofit. Because many of the micro-ingredients are highly concentrated and do not require refrigeration, they may be stored in the beverage dispenser itself (as opposed to a conventional bag in box remote from the dispenser) with the use of several metering devices. Such a "side car" retrofit could greatly expand the flexibility of current dispensers.

Figure 5:
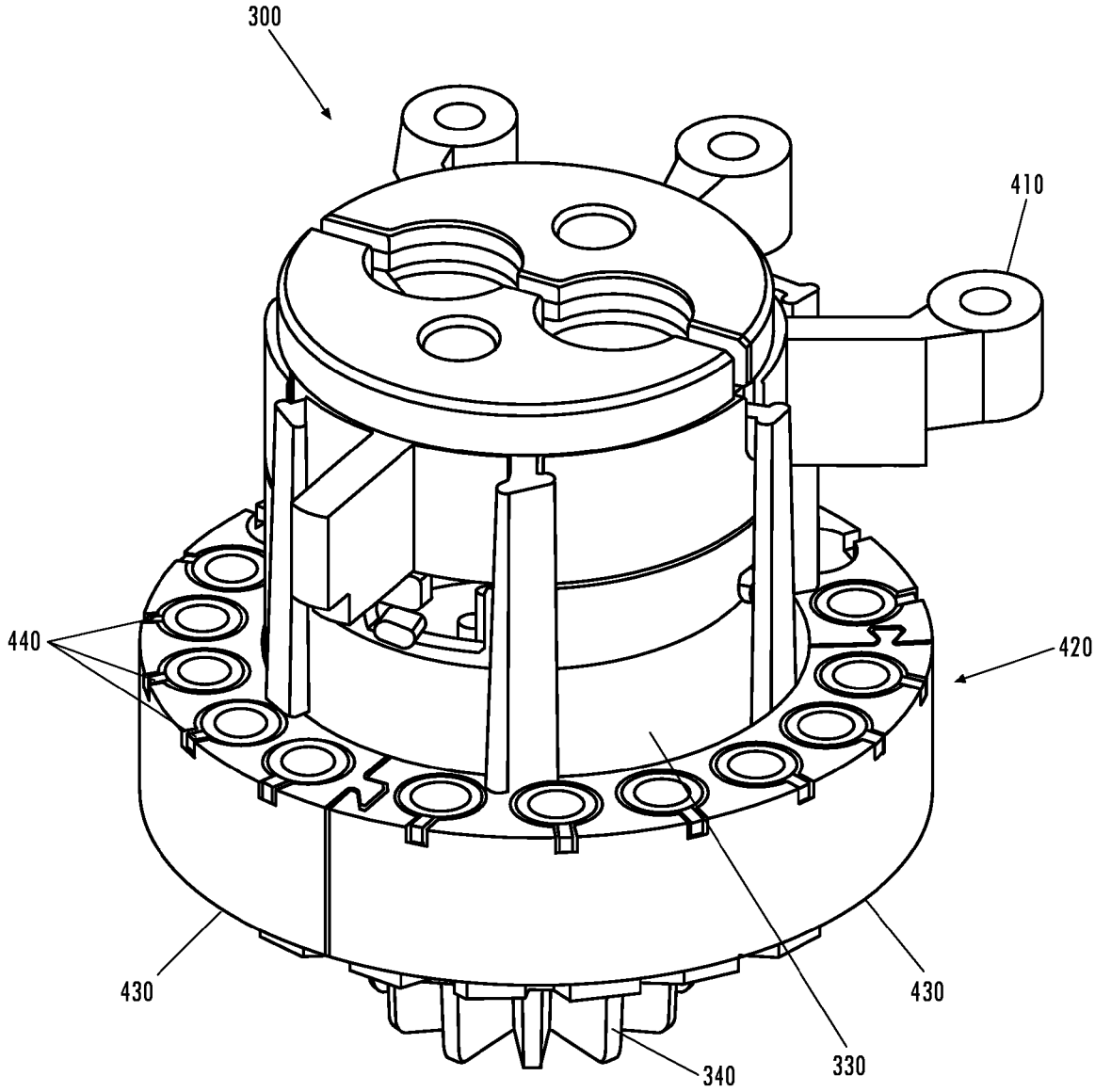
FIG. 5 is a perspective view of an alternative dispensing nozzle assembly as is described herein.
Figure 6:
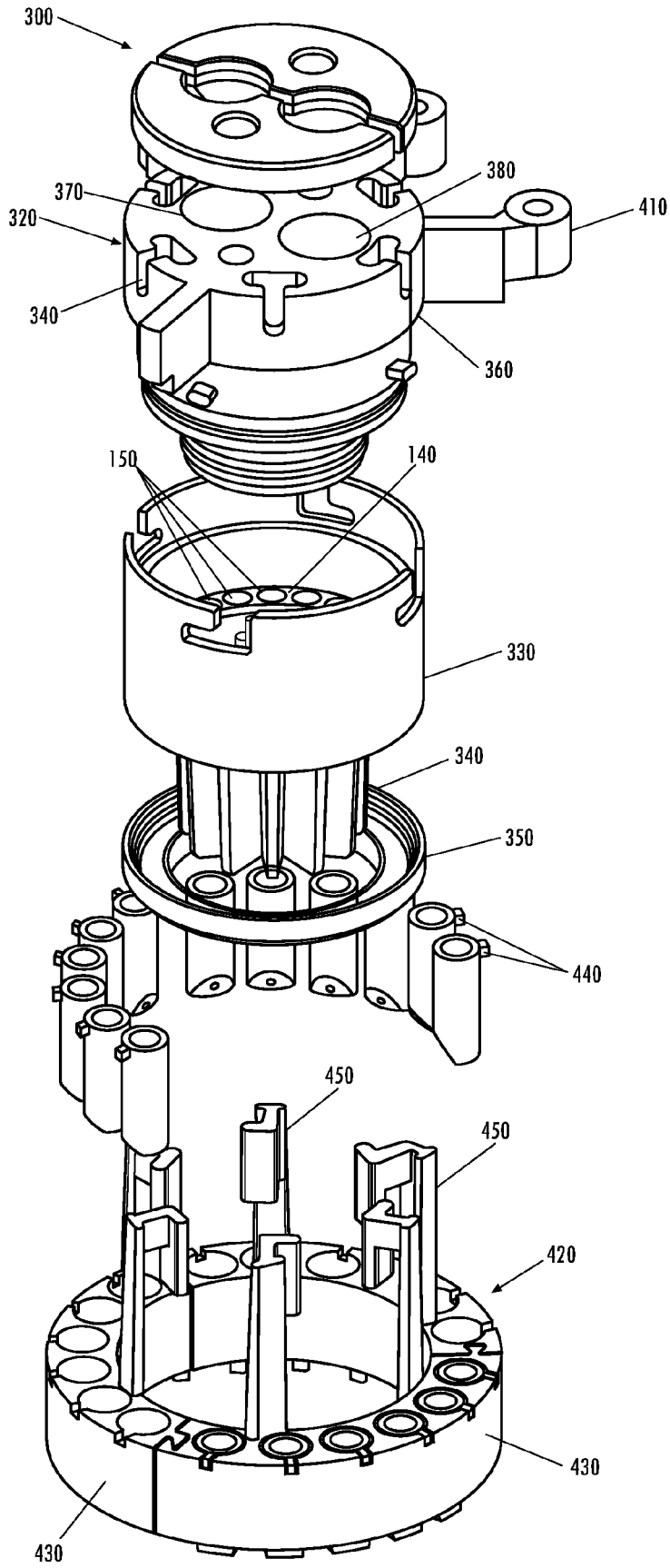
FIG. 6 is an exploded view of the dispensing nozzle assembly of FIG. 5.
Figure 7:
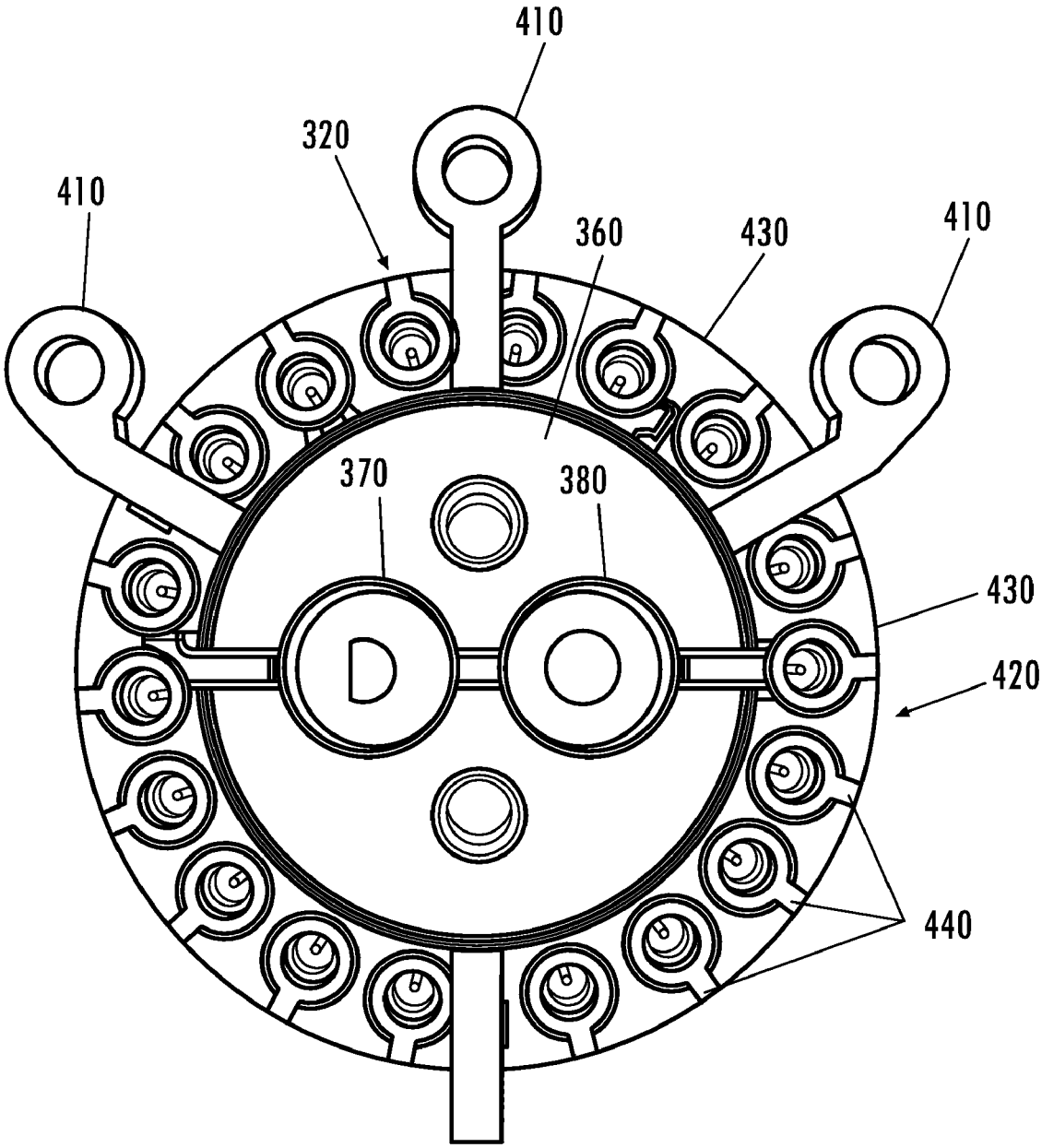
FIG. 7 is a top plan view of the dispensing nozzle assembly of FIG. 5.
Figure 8:
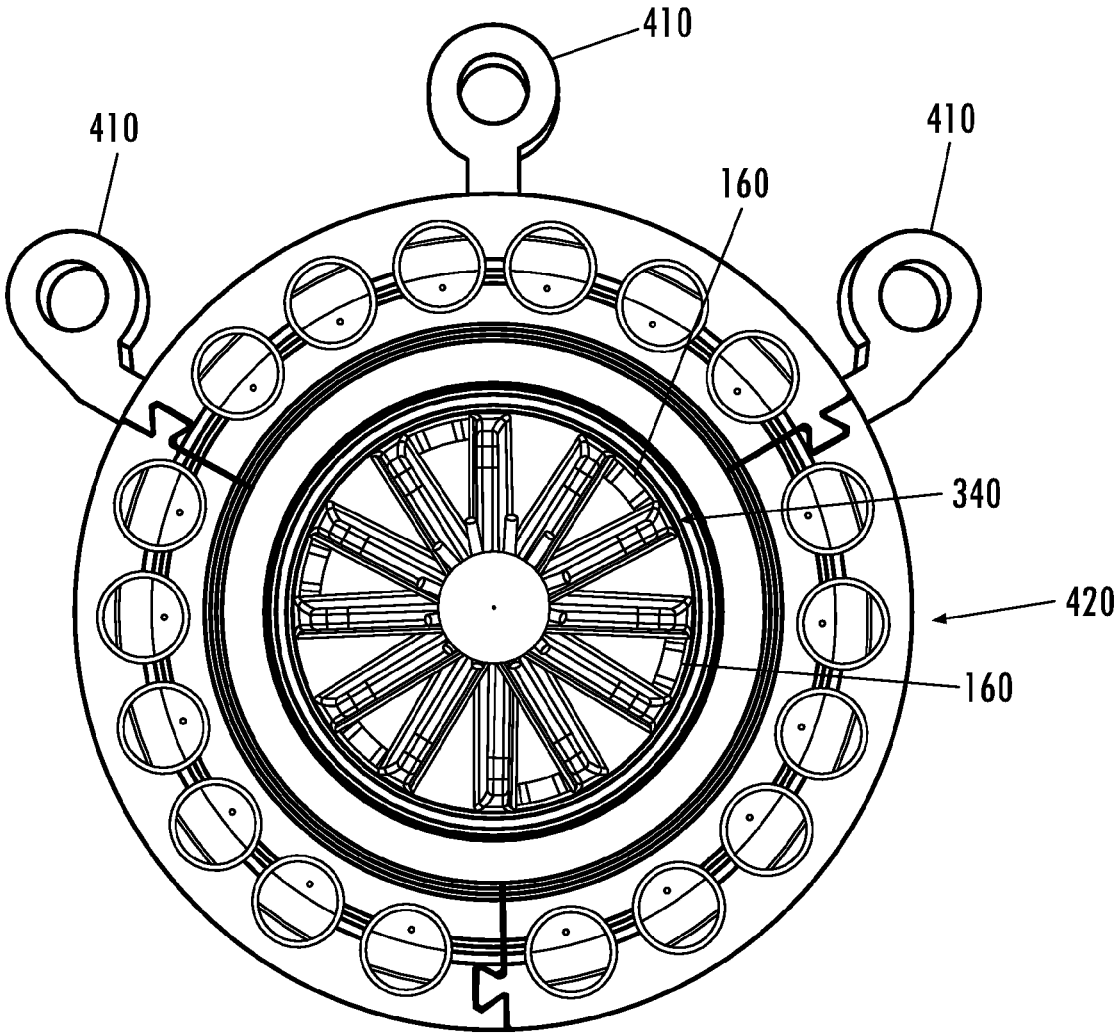
FIG. 8 is a bottom plan view of the dispensing nozzle assembly of FIG. 5.

FIGS. 5 through 8 show a further embodiment of a dispensing nozzle assembly 300. The dispensing nozzle assembly 300 may be attached to the base 110 as is described above. The dispensing nozzle assembly 100 includes a flow director 320. The flow director 320 may include an outer chamber 330. The outer chamber 330 may be substantially similar to that described above with respect to the outer chamber 130 and may include the shelf 140, the shelf apertures 150, the floor apertures 160, and the connectors 170. The dispensing nozzle assembly 300 also may include a target 340. The target 340 may be substantially similar to the target 210 described above. The target 340 may include the fins 220 and the channels 230. The outer chamber 330 and the target 340 may be an integral unit. The dispensing nozzle assembly 300 also may include a ring 350. The ring 350 may be substantially similar to the ring 240 described above and may be positioned beneath the outer chamber 330.

The flow director 320 also may include an inner cylinder 360. The inner cylinder 360 may be positioned within the outer chamber 330. The inner cylinder 360 may include a first conduit 370 and second conduit 380. The first conduit 370 may extend through the inner cylinder 360 and may be in communication with the shelf apertures 150. The second conduit 380 may extend through the inner cylinder 360 and may be in communication with the floor apertures 160. The conduits 370, 380 may be sized and/or configured to accommodate particular types of fluid flow characteristics. Likewise, the conduits 370, 380 may be sized to accommodate a particular type or speed of pump or metering device.

The same type of fluid also may be used for both of the conduits 370, 380, e.g., one conduit 370 could be used for plain water and one conduit 380 could be used for carbonated water. Similarly, the flow director 320 also could have only one conduit therethrough or the flow director 320 may have more than two conduits therethrough. Any number of conduits may be used herein.

The inner cylinder 360 further may have a number of clip apertures 390 positioned thereon. The clip apertures 390 will be used for the additional modules described below. The inner cylinder 380 may have a top plate 400 positioned thereon. The inner cylinder 360 also may have a number of mounting tabs 410 positioned thereon for mating with the base 110 as is described above. The mounting tabs 410 also can be positioned elsewhere on the dispensing nozzle assembly 300. Any type of connection means may be used herein.

The dispensing nozzle assembly 300 further may have a tertiary flow assembly 420 positioned about the outer chamber 330. The tertiary flow assembly 420 may encircle the outer chamber 330 in full or in part. The tertiary flow assembly 420 may include a number of flow modules 430. The flow modules 430 may have one or more module conduits 440 extending therethrough. The module conduits 440 may be aimed at the target 210 as described above. The module conduits 440 may be sized and/or configured to accommodate a particular type of fluid flow characteristics. Likewise, the conduits 440 may be sized to accommodate a particular type or speed of pump or metering device. The tertiary flow assembly 250 may have conduits 440 of differing size and/or configuration based upon the different types of fluids intended to be used therein.

The flow modules 430 each may have a mounting tab 450 for mating with the clip apertures 390 of the outer chamber 330. Any other type of connection means maybe used herein.

In use, a first fluid may flow through the first conduit 370 of the outer chamber and out via the shelf apertures 350. A second fluid may flow through the second conduit 380 and out via the floor apertures 160. A third fluid may flow through the tertiary assembly 420 and out via the conduits 440. Any number of other and further fluids also may flow through the tertiary assembly 420. The fluids then mix as they pass down the channels 230 of the target 210 and into the cup. As described above, the first fluid may be water or other type of diluent; the second fluid may be a concentrate, a syrup, or other type of macro-ingredient; and the third fluid may be an additive or other type of micro-ingredient. Likewise, the first fluid may be water or diluent, the second fluid may be a sweetener such as HFCS, and the third fluid may be an unsweetened flavored concentrate, acid and non-acid flavoring components, and/or an additive. As such, any number of flavors and fluids may be dispensed via the dispensing nozzle assembly 300.

Figure 9:
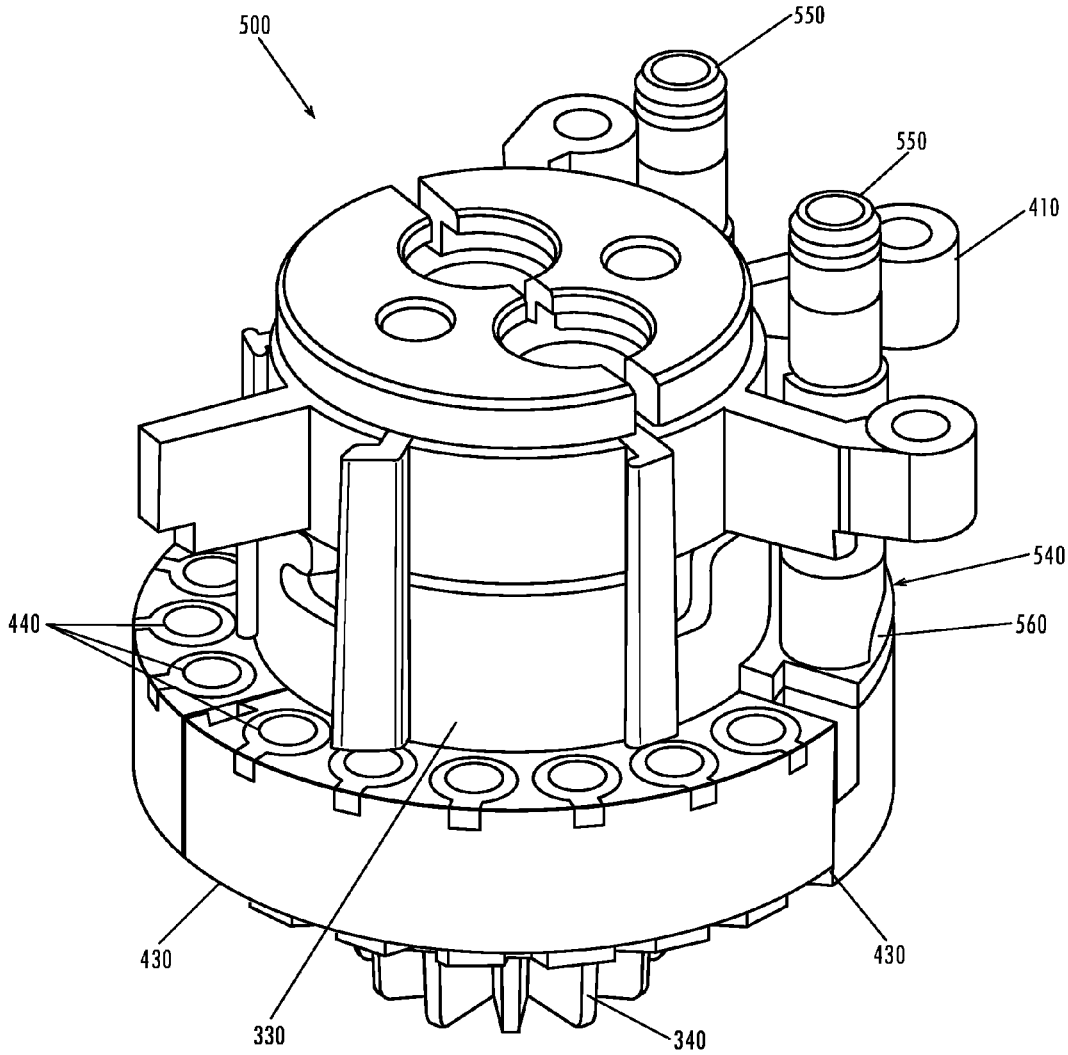
FIG. 9 is a perspective view of an alternative dispensing nozzle assembly as is described herein.
Figure 10:
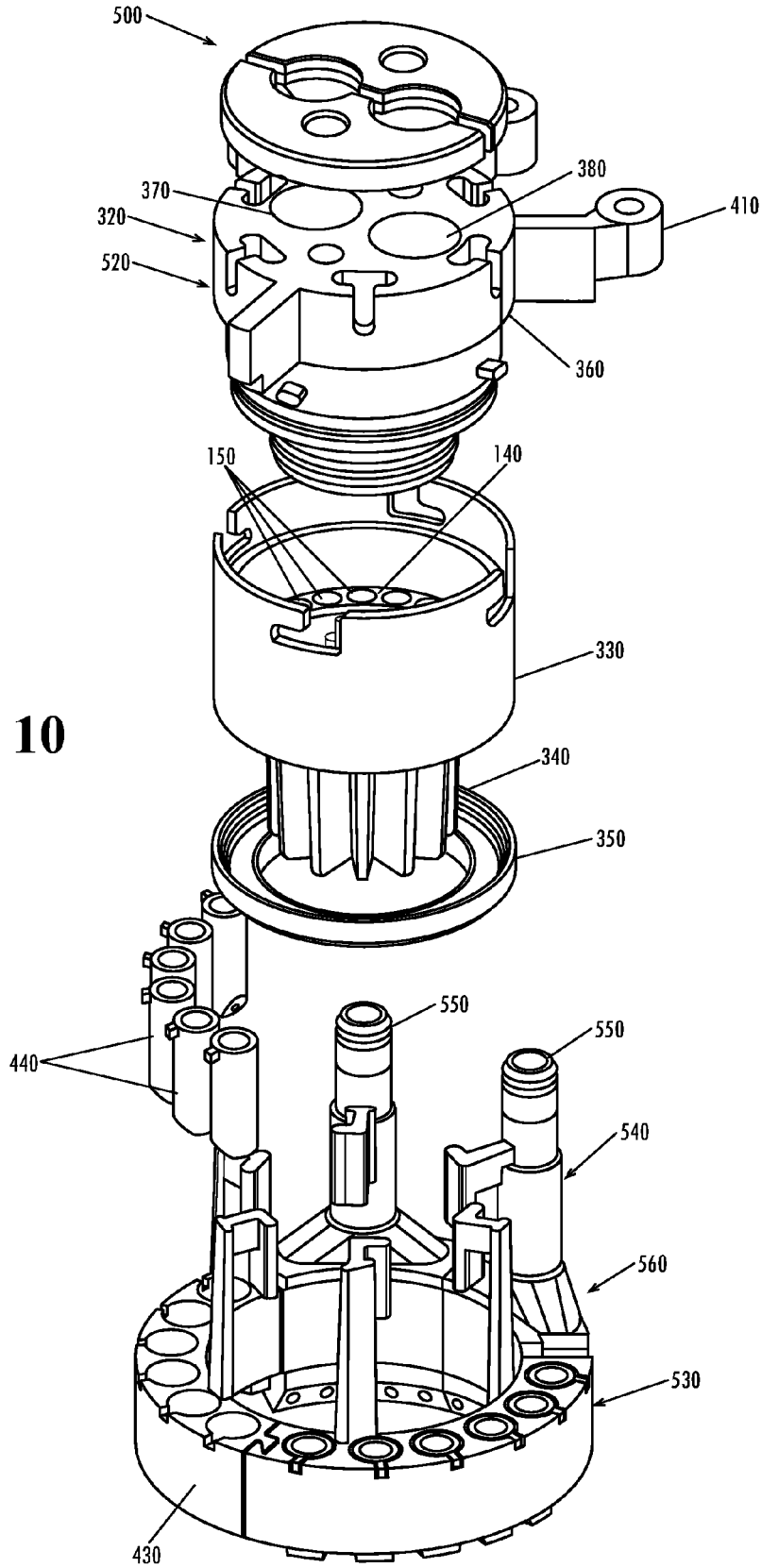
FIG. 10 is an exploded view of dispensing nozzle assembly of FIG. 9.
Figure 11:
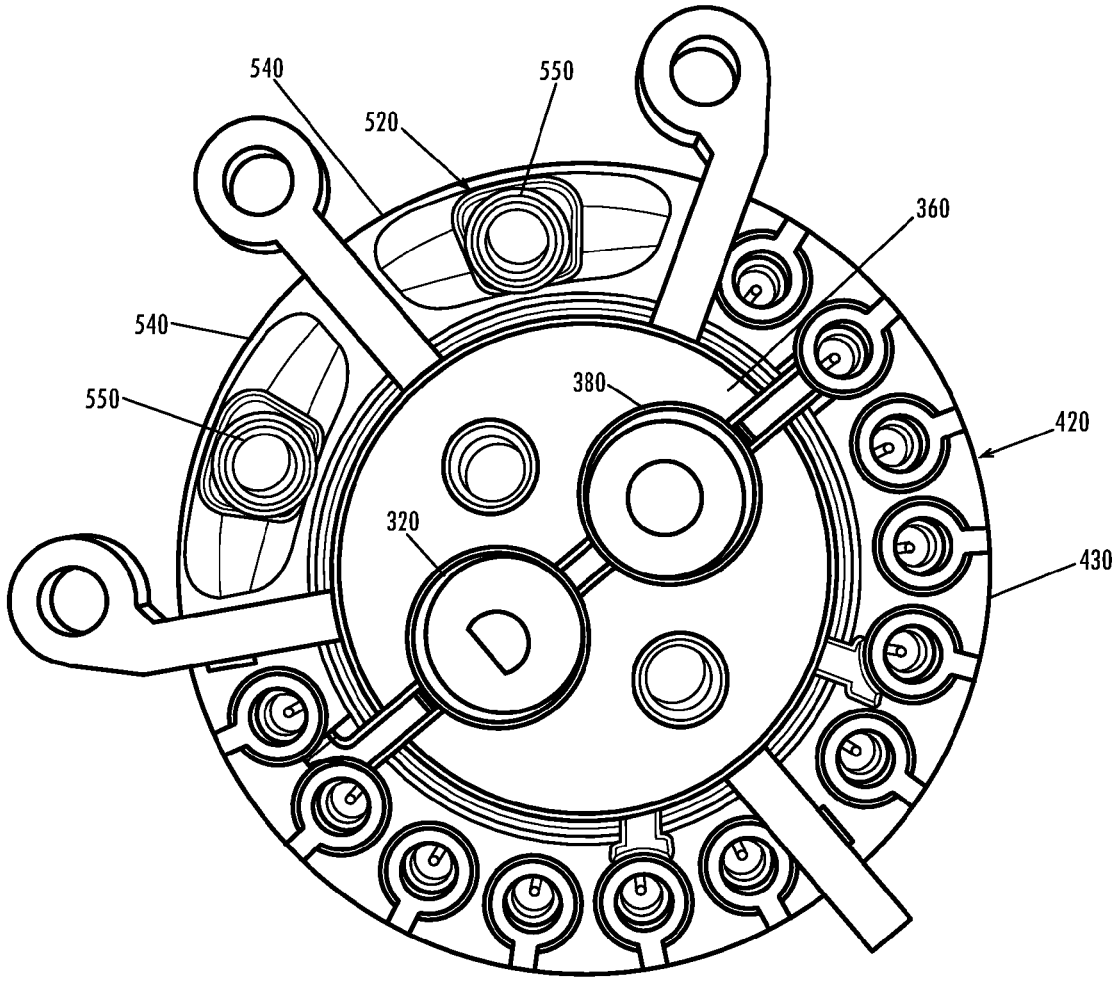
FIG. 11 is a top plan view of the dispensing nozzle assembly of FIG. 9.
Figure 12:
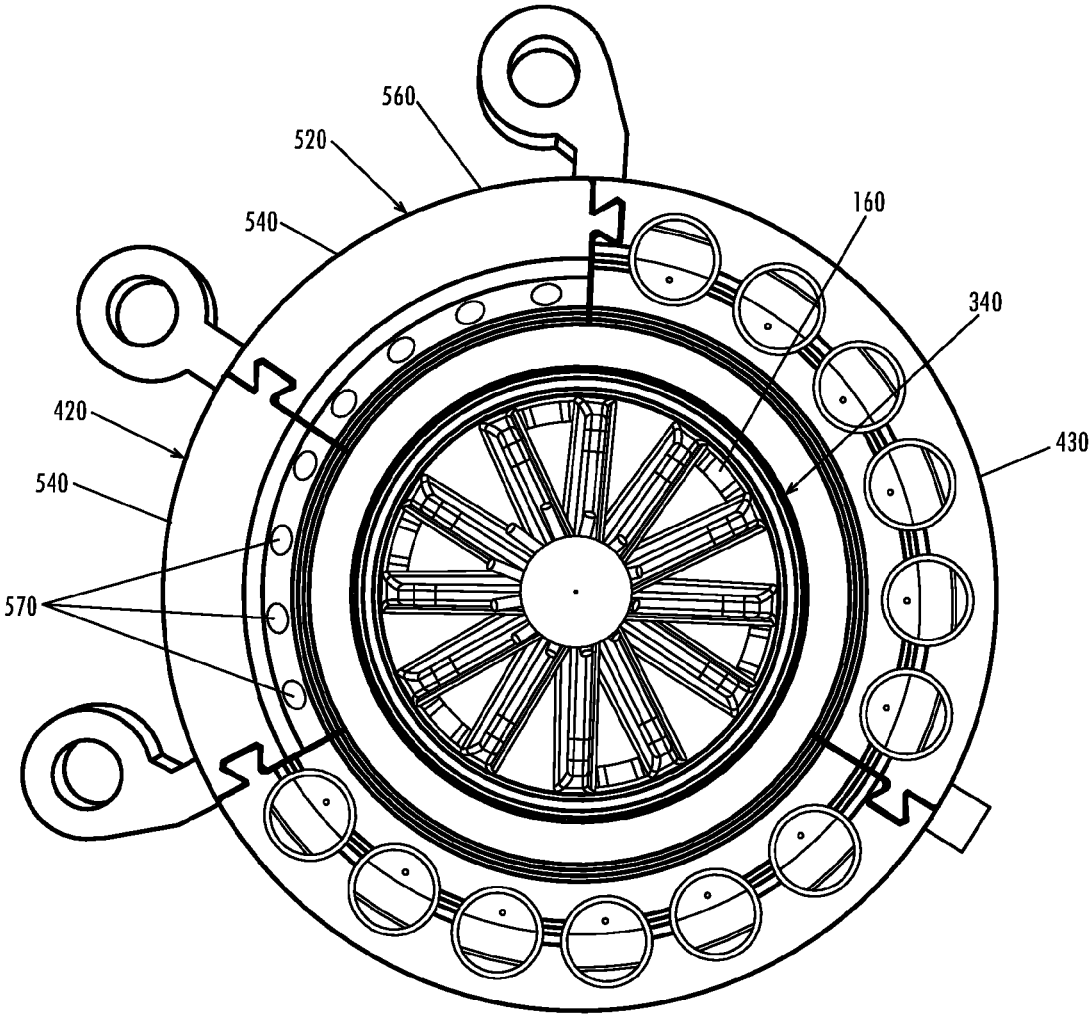
FIG. 12 is a bottom plan view of the dispensing nozzle assembly of FIG. 9.

FIGS. 9 through 12 show a further embodiment of a dispensing nozzle assembly 500. The dispensing nozzle assembly 500 may be attached to the base 110 as described above. The dispensing nozzle assembly 500 further may include a flow director 520. The flow director 520 may be substantially similar to that described above with respect to the flow director 320. Specifically, the flow director 520 includes the outer chamber 330 and the inner cylinder 360. The dispensing nozzle assembly 500 also includes the target 340 and the ring 350.

The dispensing nozzle assembly 500 also may include a tertiary flow assembly 530. The tertiary flow assembly 330 may be substantially similar in part to the tertiary assembly 420 described above. The tertiary flow assembly 530 may include one or more of the flow modules 430 with the module conduits 440 position therein. The tertiary flow assembly 530 also may include a number of multi-aperture modules 540. The multi-aperture modules 540 may have a single incoming conduit 550. The incoming conduit 550 may lead to a chamber 560. The chamber 560, in turn, may have a number of apertures therein 570. The apertures 570 may be aimed towards the target 340. The multi-aperture modules 540 may be sized and/or configured to accommodate a particular type of fluid flow characteristics. Likewise, the modules 540 may be sized to accommodate a particular type or speed of pump or metering device. The tertiary flow assembly 530 may have modules 540 of differing size or configuration based upon the different types of fluids intended to be used therein. The modules 540 may be similar to the syrup module 350 described in commonly owned U.S. patent application Ser. No. 10/233,867, described above. The dispensing nozzle assembly 500 may be operated in a manner similar to that described above with respect to dispensing valve 300. A number of dispensing nozzle assemblies may be used together in any orientation.

The dispensing nozzle assemblies described herein may be used in a number of different beverage dispensers, including that described in commonly owned U.S. patent application Ser. No. 11/276,550, entitled "Beverage Dispensing System" and U.S. patent application Ser. No. 11/276,549, entitled "Juice Dispensing System", incorporated herein by reference. The assemblies described herein also may be used with a number of different pumps, including those described in commonly owned U.S. patent application Ser. No. 11/276,548, entitled "Pump System with Calibration Curve"; incorporated herein by reference.

Other embodiments may use the flow directors 120, 320, 520 and the tertiary flow assemblies 250, 420, 530 but without the targets 210, 340. In this case, the fluid streams would air mix and continue mixing within the cup. Likewise, certain fluids may flow through the target 210, 340 while others would air mix below the target 210, 340.

Further, the timing of the streams may be varied. For example, a stream exiting the tertiary flow assemblies 250, 420, 530 may have a color component therein such a concentrate or a coloring. The flow of the tertiary flow assembly 250, 420, 530 may cease before the flow of a clear fluid, such a diluent, from the flow director 120, 320, 520 is stopped so as to flush the colored fluid off of the target 210, 340. This water flush can be used with any type of fluid stream. A gas flush also may be used. Likewise, certain types of the micro-ingredients, macro-ingredients, diluents, or other fluids may have different types of mixing characteristics. As such, different flow rates and flow timing may be employed so as to promote good mixing, e.g., certain fluid streams may be added early or late, certain fluid streams may be pulsed, etc.

Although the dispensing nozzle assemblies have been described in detail in the context of a liquid beverage, other fluids, gas, dissolved gas, dissolved solids, and non-dissolved (aerosols), and solids also may be used herein, alone and in any combination. Non-beverage fluids also may be used herein, such as paints, pigments, curing chemicals, cosmetics, air fresheners, etc.

It should be apparent that the foregoing relates only to the preferred embodiments of the present application and that numerous changes and modifications may be made herein without departing from the general spirit and scope of the invention as defined by the following claims and the equivalents thereof.

We claim:

1. A nozzle assembly, comprising:

a flow director;

the flow director comprising a first flow path and a second flow path;

a tertiary flow assembly;

the tertiary flow assembly comprising a plurality of third flow paths; and an elongated target positioned about the flow director such that the first flow path, the second flow path, and the plurality of third flow paths merge along or below the elongated target;

wherein the tertiary flow assembly comprises a plurality of differently sized conduits extending therethrough for the plurality of third flow paths.

2. The nozzle assembly of claim 1, wherein the flow director comprises an outer chamber.

3. The nozzle assembly of claim 2, wherein the outer chamber comprises an internal shelf and wherein the internal shelf comprises a plurality of shelf apertures therein.

4. The nozzle assembly of claim 3, wherein the first flow path extends through the plurality of shelf apertures.

5. The nozzle assembly of claim 3, wherein the outer chamber comprises a plurality of floor apertures.

6. The nozzle assembly of claim 5, wherein flow director comprises an inner cylinder positioned within the outer chamber.

7. The nozzle assembly of claim 6, wherein the inner chamber comprises a plurality of conduits and wherein the plurality of conduits is in communication with the plurality of floor apertures.

8. The nozzle assembly of claim 7, wherein the second flow path extends through the plurality of conduits and the plurality of floor apertures.

9. A nozzle assembly comprising:

a flow director;

the flow director comprising a first flow path and a second flow path;

a tertiary flow assembly;

the tertiary flow assembly comprising a plurality of third flow paths; and an elongated target positioned about the flow director such that the first flow path, the second flow path, and the plurality of third flow paths merge along or below the elongated target;

wherein the target comprises a plurality of fins that define a plurality of channels.

10. The nozzle assembly of claim 1, further comprising a ring positioned about the flow director adjacent to the first flow path and the second flow path.

11. The nozzle assembly of claim 1, further comprising a ring positioned about the flow director adjacent to the first flow path and the second flow path.

12. The nozzle assembly of claim 1, wherein the tertiary flow assembly encircles the flow director.

13. The nozzle assembly of claim 1, wherein the tertiary flow assembly encircles the flow director in part.

14. The nozzle assembly of claim 1, wherein the plurality of conduits comprises a plurality of different configurations.

15. The nozzle assembly of claim 6, wherein the inner cylinder comprises a first conduit and a second conduit therethrough.

16. The nozzle assembly of claim 15, wherein the first flow path extend through the first conduit and the plurality of shelf apertures.

17. The nozzle assembly of claim 15, wherein the second flow path extends through the second conduit and the plurality of floor apertures.

18. A nozzle assembly comprising:

a flow director;

the flow director comprising a first flow path and a second flow path;

a tertiary flow assembly;

the tertiary flow assembly comprising a plurality of third flow paths; and an elongated target positioned about the flow director such that the first flow path, the second flow path, and the plurality of third flow paths merge along or below the elongated target;

wherein the tertiary assembly comprise a plurality of flow modules.

19. The nozzle assembly of claim 18, wherein the plurality of flow modules comprises a plurality of conduits extending therethrough for the plurality of third flow paths.

20. The nozzle assembly of claim 19, wherein the plurality of conduits comprises a plurality of different sizes.

21. The nozzle assembly of claim 19, wherein the plurality conduits comprises a plurality of different configurations.

22. The nozzle assembly of claim 18, wherein the plurality of flow modules comprises a multi-aperture module.

23. The nozzle assembly of claim 22, wherein the multi-aperture module comprises a plurality of multi-aperture modules with apertures of a plurality of difference sizes.

24. The nozzle assembly of claim 22, wherein the multi-aperture module comprises a plurality of multi-aperture modules with apertures of a plurality of difference configurations.

25. A nozzle assembly, comprising:

an outer chamber;

the outer chamber comprising a first plurality of apertures and a second plurality of apertures;

an inner cylinder positioned within the outer chamber;

the inner cylinder comprising a first conduit and a second conduit;

the first conduit being in communication with the first plurality of apertures and the second conduit being in communication with the second plurality of apertures;

a tertiary flow assembly;

the tertiary flow assembly comprising a plurality of flow modules;

wherein the plurality of flow modules comprises a plurality of differently sized conduits extending therethrough for a plurality of third flow paths; and a target positioned about the first plurality of apertures, the second plurality of apertures, and the plurality of flow modules.

26. The nozzle assembly of claim 25, wherein the plurality conduits comprise a plurality of different configurations.

27. The nozzle assembly of claim 25, wherein the plurality of flow modules comprises a multi-aperture module.

28. A nozzle assembly, comprising:

a flow director;

the flow director comprising one or more flow paths therein;

wherein the one or more flow paths comprise at least one water flow path; and a flow assembly surrounding the flow director;

the flow assembly comprising a plurality of modules;

the modules comprising a plurality of micro-ingredient flow paths sized for fluids having a reconstitution ratio of about ten to one (10:1) or higher.

29. The nozzle assembly of claim 28, wherein the flow director comprises a macro-ingredient flow path therein.

30. The nozzle assembly of claim 28, further comprising a target positioned beneath the flow director.

31. The nozzle assembly of claim 28, wherein the plurality of modules comprises a multi-aperture module.

32. A method of dispensing a beverage through a nozzle assembly having a target, comprising:

flowing a first fluid stream along the target;

flowing a micro-ingredient fluid stream along the target;

mixing in part the first fluid stream and the micro-ingredient fluid stream along the target; and stopping the flow of the micro-ingredient fluid stream before stopping the flow of the first fluid stream along the target so as to flush any remaining micro-ingredient fluid off of the target.

33. The method of claim 32, wherein the step of flowing a micro-ingredient fluid stream comprising flowing a colored micro-ingredient fluid stream.

* * * * *